United States Patent [19]

Takano

[11] Patent Number: 5,051,549

[45] Date of Patent: Sep. 24, 1991

[54] SLIDE SWITCH

[75] Inventor: Tsunesuke Takano, Tokyo, Japan

[73] Assignee: Kabushiki Kaisha T AN T, Tokyo, Japan

[21] Appl. No.: 603,449

[22] Filed: Oct. 26, 1990

[30] Foreign Application Priority Data

Dec. 22, 1989 [JP] Japan ..... 1-334215
May 9, 1990 [JP] Japan ..... 2-119517

[51] Int. Cl.[5] ..... H01H 15/00
[52] U.S. Cl. ..... 200/16 C; 200/16 D
[58] Field of Search ..... 200/16 C, 16 D, DIG. 29

[56] References Cited

U.S. PATENT DOCUMENTS

| | | | |
|---|---|---|---|
| 2,892,046 | 6/1959 | La Pointe | 200/16 C X |
| 3,150,240 | 9/1964 | Voss | 200/16 C X |
| 3,226,515 | 12/1965 | Concelman | 200/16 C X |
| 3,413,431 | 11/1968 | Bang | 200/16 C X |
| 3.757,060 | 9/1973 | Ianuzzi et al. | 200/16 C |
| 4,514,602 | 4/1985 | Owen | 200/16 C |

FOREIGN PATENT DOCUMENTS

| | | | |
|---|---|---|---|
| 2356501 | 5/1975 | Fed. Rep. of Germany | 200/16 C |

*Primary Examiner*—J. R. Scott

*Attorney, Agent, or Firm*—Nixon & Vanderhye

[57] ABSTRACT

Slide switches have an electrically insulated slide body which is slidably disposed within an interior cavity defined in an electrically insulated support housing. The slide body has a knob which projects through a opening defined in an upper wall of the support housing so as to allow manual movement of the slide body between the first and second positions. At least one pair of elongated conductors is provided with the opposed ends being fixed to an opposed pair of side walls of the housing so that the fixed conductors extend parallel to one another, but are positioned in spaced relationship transversely relative to the reciprocal movement of the slide body within the support housing. The slide body carries a movable conductor which is sized and configured so as to be in contact with the pair of elongate fixed conductors when the slide body is in its first position so as to make an electrical circuit therebetween. Movement of the slide body thus disengages the movable conductor from the pair of elongate fixed conductors so as to break electrical contact therebetween. A retaining plate closes lower end of the interior space of the housing such that the pair of fixed conductors are in space relationship thereto.

5 Claims, 5 Drawing Sheets

SLIDE SWITCH

FIELD OF INVENTION

The present invention relates to slide switches. More particularly, the present invention relates to slide switches having a movable conductor which serves as a movable contact and a number of narrow conductive plates (i.e., so-called bus bars), conductive tubes or conductive rods arranged in parallel which serve as fixed conductors. The fixed conductors thus make an electrical circuit when in contact astride the movable contact.

BACKGROUND AND SUMMARY OF THE INVENTION

A conventional slide switch is disclosed in Japanese Utility Model Laid-Open No. 50-23681. This prior art device prevents a movable contact from disengaging within a slide switch which performs its switching operation by pivotal movements of its movable contact. In this regard, the switch of the Japanese Utility Model No. 50-23681 is especially characterized by a movable contact having a semilunar or V-shaped tabs at the center of both sides thereof, a movable contact receptacle on which the movable contact is placed and formed of a thin elastic plate having an acute angle, a bent surface formed at a cutout portion on opposing erected surfaces and a slant surface formed at the upper portion of the erected surfaces. The receptacle thus holds the movable contact.

The above-mentioned prior art slide switch is intended to prevent the movable contact from dropping by holding the movable contact within the conductive receptacle. The movable contact is a slide switch which pivots on the conductive receptacle so as to swing when its knob is moved left or right, thereby making or breaking a circuit with the fixed contact.

As a result of such structural relationship, current flows through many contact portions—for example, a clamping terminal, a conductive receptacle, a movable contact, a fixed contact, a clamping terminal, a lead, a load and then on to the other pole of the power source. Therefore if it is used with a current route carrying large current at even a relatively low voltage, the result will be high heat due to Joule heat produced by the contact resistance at the contact portions or the clamping portions of the clamping terminals.

In addition, such a prior art switch results in a high manufacturing cost because of its complicated configuration which involves a number of parts and clamping processes affecting the efficiency of assembly.

It is therefore the objective of the present invention to eliminate several components associated with prior art slide switches thereby simplifying the same. In this regard, the present invention is embodied in a slide switch having fixed conductors comprised of plural narrow conductive plates (i.e., so called bus bars), metal tubes or conductive rods in parallel. A switch which makes an electrical circuit between the fixed conductors is provided with a movable conductor element (preferably a conductive ball) which may be moved into the gaps between an adjacent pair of fixed conductors. As a result, electrical contact between the movable conductor element and the fixed conductors is made with the latter being astride the former.

An insulated sliding body is slidably mounted in an interior cavity formed within an insulated support housing having a substantially inverted U-shaped interior cross-section. The sliding body carries a spring-biased movable conductor (preferably a conductive ball) which is adapted to contact the fixed conductors extending transversely across a lower portion of the insulated support housing. The plural fixed conductors are preferably mounted in parallel to one another by means of paired grooves formed on a lower edge portion of the insulated support housing. Thus, by providing plural cylindrical conductive tubes, rods or plates in longitudinal arrangement as fixed conductors for the slide switch, a section of the knob-operated movable conductor will be brought into the gaps between the fixed conductors. In addition, since the movable conductor is spring-biased, it will forcibly be brought into the gaps between a pair of fixed contacts in a snapping action by virtue of the spring, thereby making a circuit with the fixed conductors in contact therewith at both sides to turn on an electrical load. The elastic "snapping" action of the spring-biased knob-operated movable conductor into the gaps between the fixed conductor provides the knob operation with a beneficial click-type action.

Manual movement of the movable conductor breaks electrical contacts with the pair of fixed contacts thereby turning off the electrical load. The switch thus serves as a single pole dual position switch or a double pole dual position switch if the movable conductor is then brought into contact with another pair of the fixed conductors.

Further, since the conductive tubes, conductive rods or conductive plates used as fixed conductors may be integrally formed with a narrow conductive plate (i.e. the bus bar), the fixed conductors can be connected directly to another electronic component or a circuit pattern via the bus bar. As a result, no clamping portion or lead is required.

DESCRIPTION OF THE PREFERRED EMBODIMENTS

Figure 1:
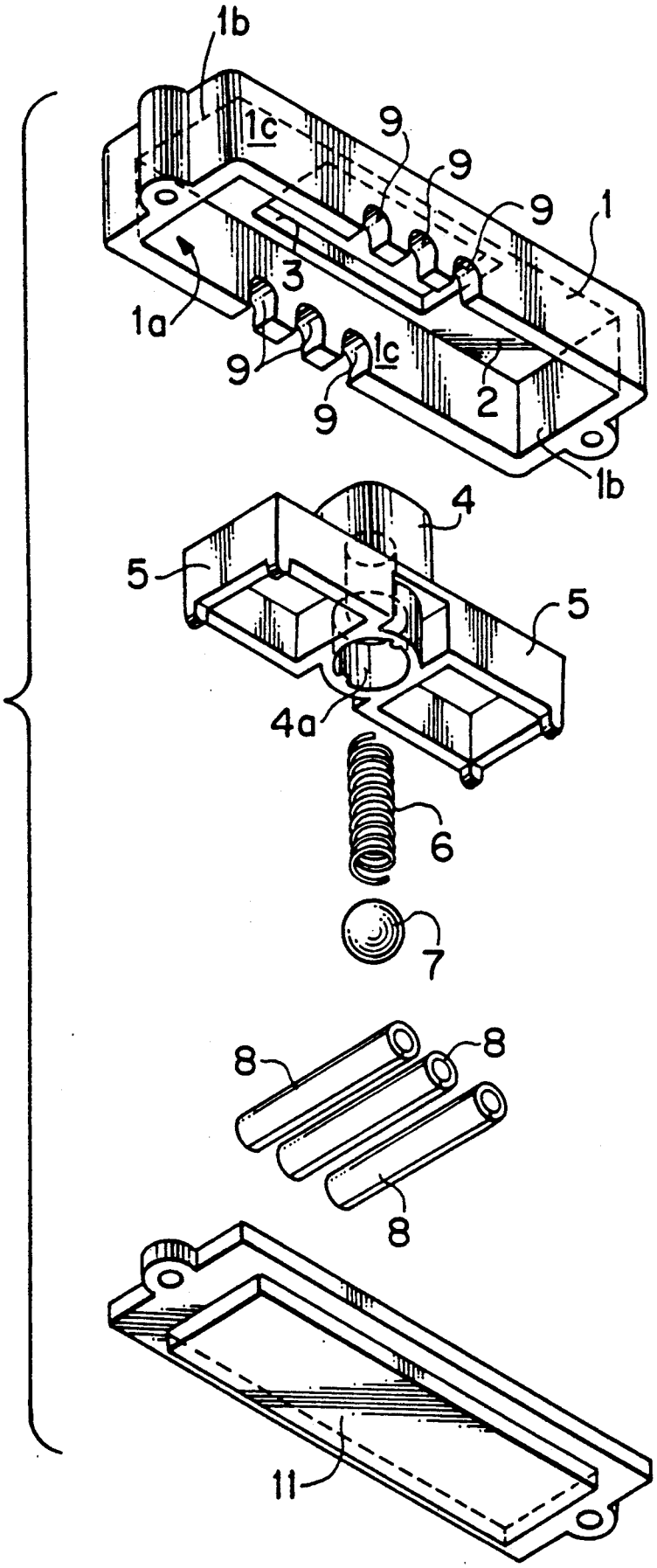
FIG. 1 is an exploded bottom perspective view of a slide switch according to this invention.
Figure 2:
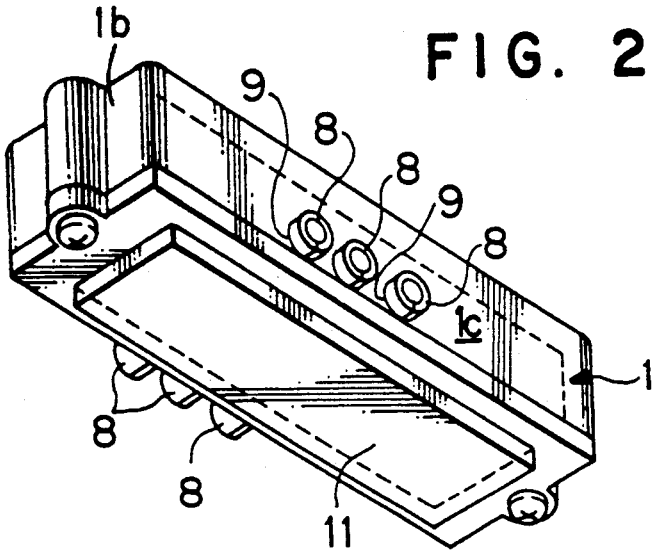
FIG. 2 is a bottom perspective illustration of the assembled slide switch shown in FIG. 1.

As shown in FIGS. 1 and 2, the basic configuration of the present invention includes a support housing 1 having a substantially inverted U-shaped interior cross-sectional space established by an opposed pair of end walls 1*b* and an opposed pair of side walls 1*c*. The housing 1 is most preferably formed of an electrically insulating plastics material. The housing 1 includes a rectangular-shaped opening 3 formed substantially at the center of its upper wall 2.

An insulated slide body 5 formed of a plastics material is movably mounted within the cavity 1*a* of the insulated housing 1 so as to be reciprocally slidable between a number of operative positions. In this regard, the slide body 5 includes a knob 4 which projects externally of the housing 1 as shown more clearly in FIG. 7. The knob 4 may thus be moved manually so as to, in turn, cause the slide body 5 to move within the cavity 1*a*.

A movable conductor 7 is provided at the lower portion of the slide body 5 so that it will move collectively with the knob 4. A spring 6 is positioned within the recess 4*a* formed in the knob 4 and exerts a downward bias force upon the movable conductor 7. The movable conductor 7 may be a conductive ball as shown in each of the drawings, or may be in the form of an inverted U-shaped piece.

Figure 4:
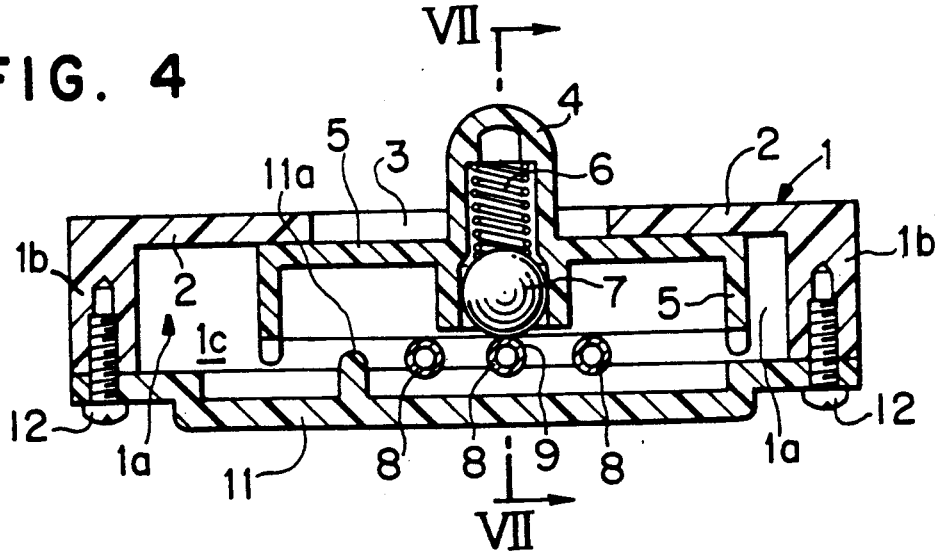
Figure 5:
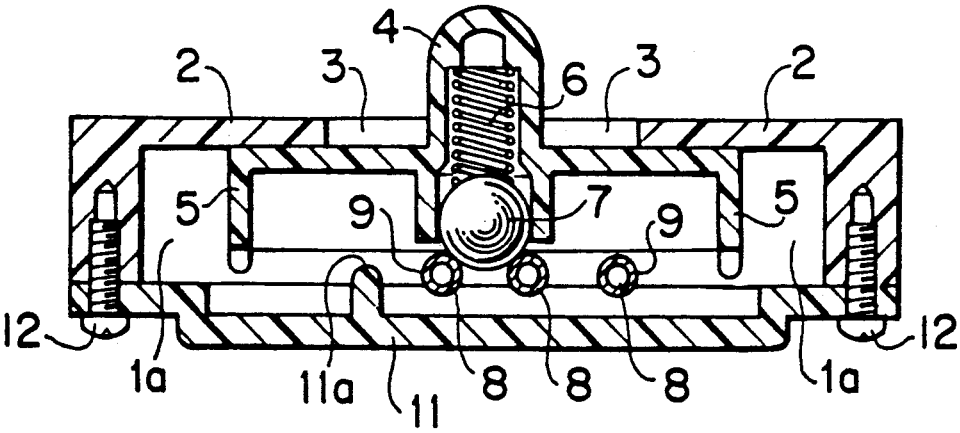
Figure 6:
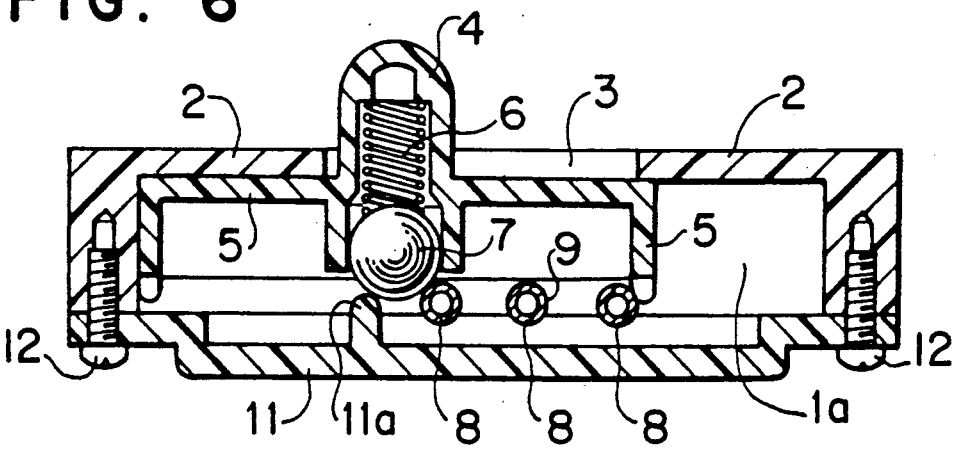

A plurality of fixed conductors 8 have opposing end portions which are rigidly fixed to the opposed pair of side walls 1*c* as shown, for example, in FIG. 2. As a result, the movable conductor is capable of being brought into contact with a selected pair of the fixed conductors 8 as will be described in greater detail below. It will further be observed that the fixed conductors 8 extend parallel to one another transversely relative to the reciprocal movement of the slide body 5. As a result, the movable conductor 7 is capable of being brought into contact with pairs of the fixed conductors 8 as shown in FIGS. 4–6.

The plural fixed conductors 8 may be secured in parallel to the lower portion of the insulated housing 1 by forcing them tightly into grooves 9. A retaining plate 11 may then be used to retain the fixed conductors 8 in the grooves 9. In this connection, it will be observed particularly with reference to FIGS. 2–7 that the fixed conductors 8 are vertically spaced above the retaining plate 11. In case the fixed conductors 8 are round tubes as illustrated, a plug-in type connecting lobe may be inserted into its hole so as to effect wiring connection to other members via a lead wire, for example.

Figure 3:
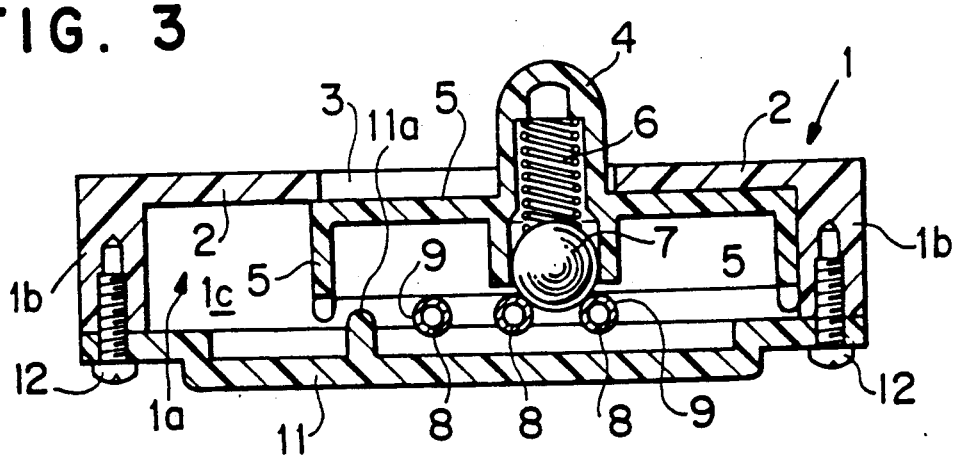
FIG. 3 through FIG. 6 are vertical sectional views of a slide switch in different operational states.
Figure 7:
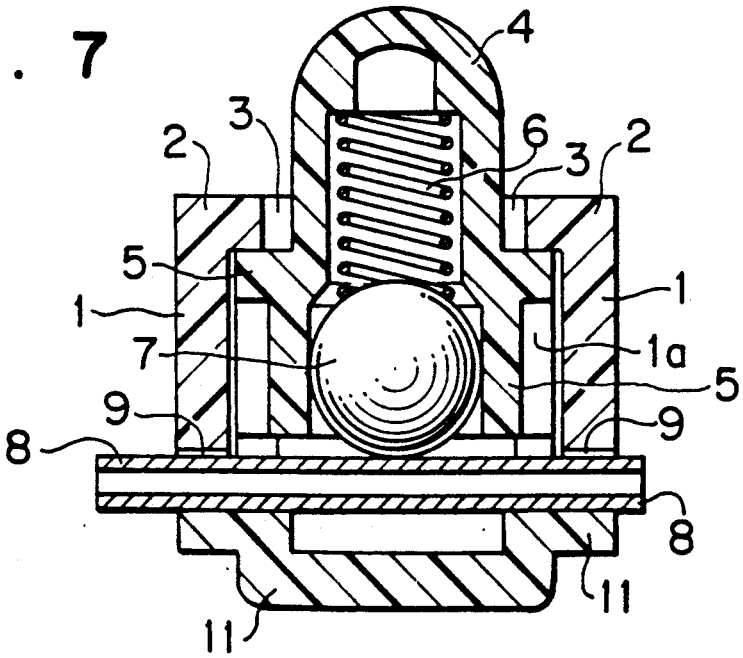
FIG. 7 is an enlarged sectional view as taken along line VII—VII in FIG. 4.

During assembly, the spring 6 is inserted into the recess 4*a* of the knob 4 at substantially the center of the hollow rectangular sliding body 5 as shown in FIGS. 1, 3 and 7. The movable connector may then be inserted into the recess 4*a* so that the spring 6 is interposed therebetween. The fixed conductors 8 are then mounted on the lower portion of the insulated housing 1 as shown in FIGS. 3 and 7. The knob 4 is inserted into the hole 3 defined in the upper wall 2 so that the movable body is physically received within the recess 1*a* of the insulated housing 1. During this procedure, the movable conductor 7 is kept in place by, for example, turning it upside down so that it will not come out due to the elasticity of the spring 6 after the fixed conductors 8 are mounted. The retaining plate 11 is screwed onto the insulated housing 1. The plate 11 will thus slightly push the movable conductor into the recess 4*a* against the elasticity of the spring 6. That is, the sliding body 5 is inserted into the recess 1*a* of the insulated housing 1 as shown in FIGS. 3 and 7 so that the knob 4 projects outwardly from the hole 3.

The fixed conductors 8 are fitted into the grooves 9 on the insulated housing 1 against the elasticity of the spring 6 as shown in FIGS. 1 and 2 and are mounted on the bottom surface of the insulated housing 1 using an anchoring piece or locking screws (not shown) to complete the slide switch according to the present invention.

Movement of the movable conductor 7 to the right as shown in FIG. 3 causes the movable conductor to make contact with the center and right-hand fixed conductors 8. When the knob 4 is moved to a center position as shown in FIG. 5 (i.e., after moving through the state shown in FIG. 4), the other set of fixed conductors 8 (i.e., comprised of the left-hand and center conductors 8) will be electrically connected via the movable conductor 7. Also as shown in FIG. 6, if the knob is moved further to the left, the movable conductor 7 will be stopped by a projection 11*a* on the retaining plate 11. This action will in turn break the electrical conduction between all the fixed conductors 8 causing the switch to be turned off.

Figure 8:
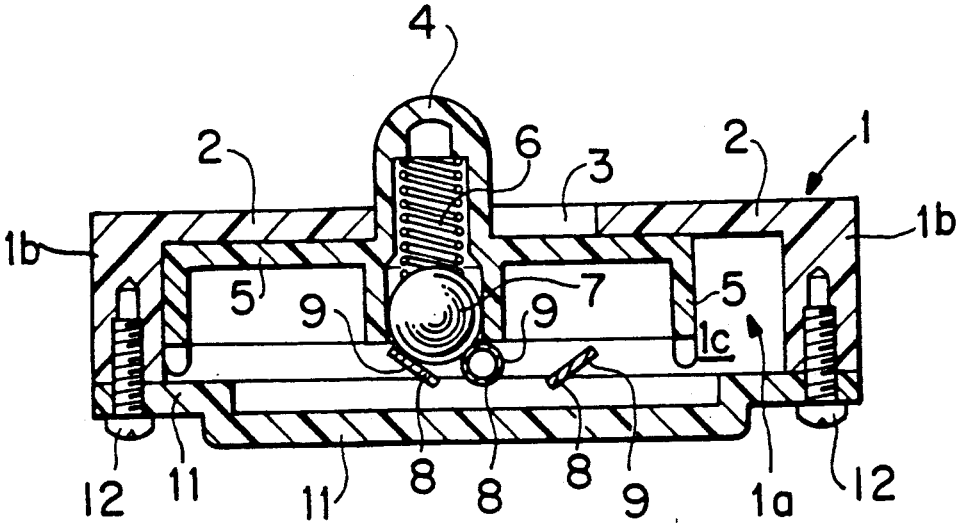
FIGS. 8 and 9 are sectional views illustrative of another embodiment of the present invention.
Figure 9:
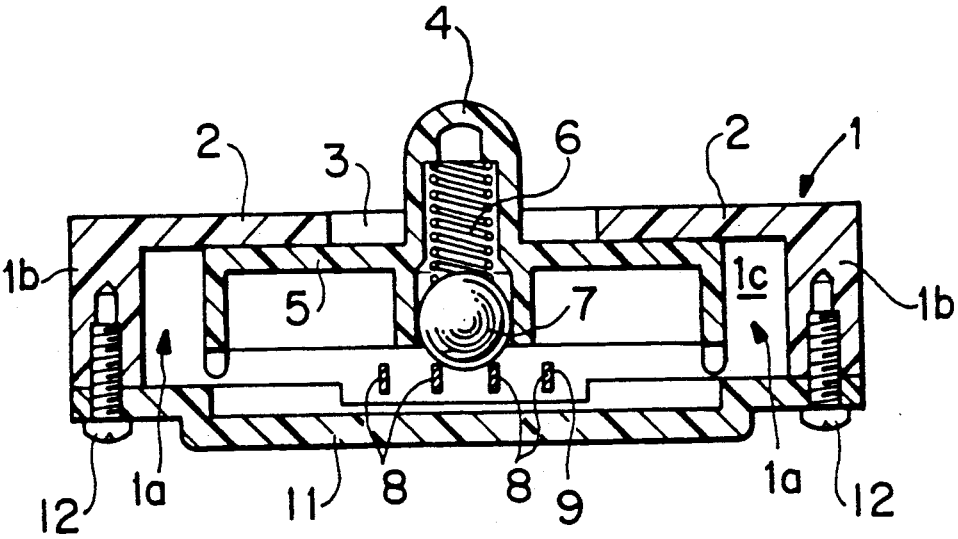

The shape of the fixed conductors 8 is not limited to the round tubes as mentioned above. A conductive piece comprising a central fixed conductor 8 sandwiched by two fixed slant conductors as shown in FIG. 8 or bus bars longitudinally arranged in parallel may be used.

The procedure for the assembly of another embodiment will be described with reference to FIG. 10. In this regard, the movable conductor 7 is inserted into the recess 4*a* of the knob 4 provided at the substantial center of the hollow rectangular sliding body 5 formed of plastic as shown in FIG. 1 with the spring 6 interposed within the recess 4*a*. Narrow plates 15 are then applied to the lower portion of the insulated housing 1 and the knob 4 is inserted into the hole 3 provided at the upper plate 2 of a recess on the insulated housing 1 while the movable conductor 7 is kept in place by, for example, turning it upside down so that it will not come out due to the elasticity of the spring 6. After the narrow plates are applied, the retaining plate 11 is screwed onto the insulated housing 1 with screws 12 as shown in FIG. 5 so that the movable conductor 7 will be slightly pushed into the recess against the elasticity of the spring 6. That is, the sliding body 5 is inserted into the recess of the insulated housing 1 as shown in FIG. 5 so that the knob 4 will project from the hole 3.

Figure 10:
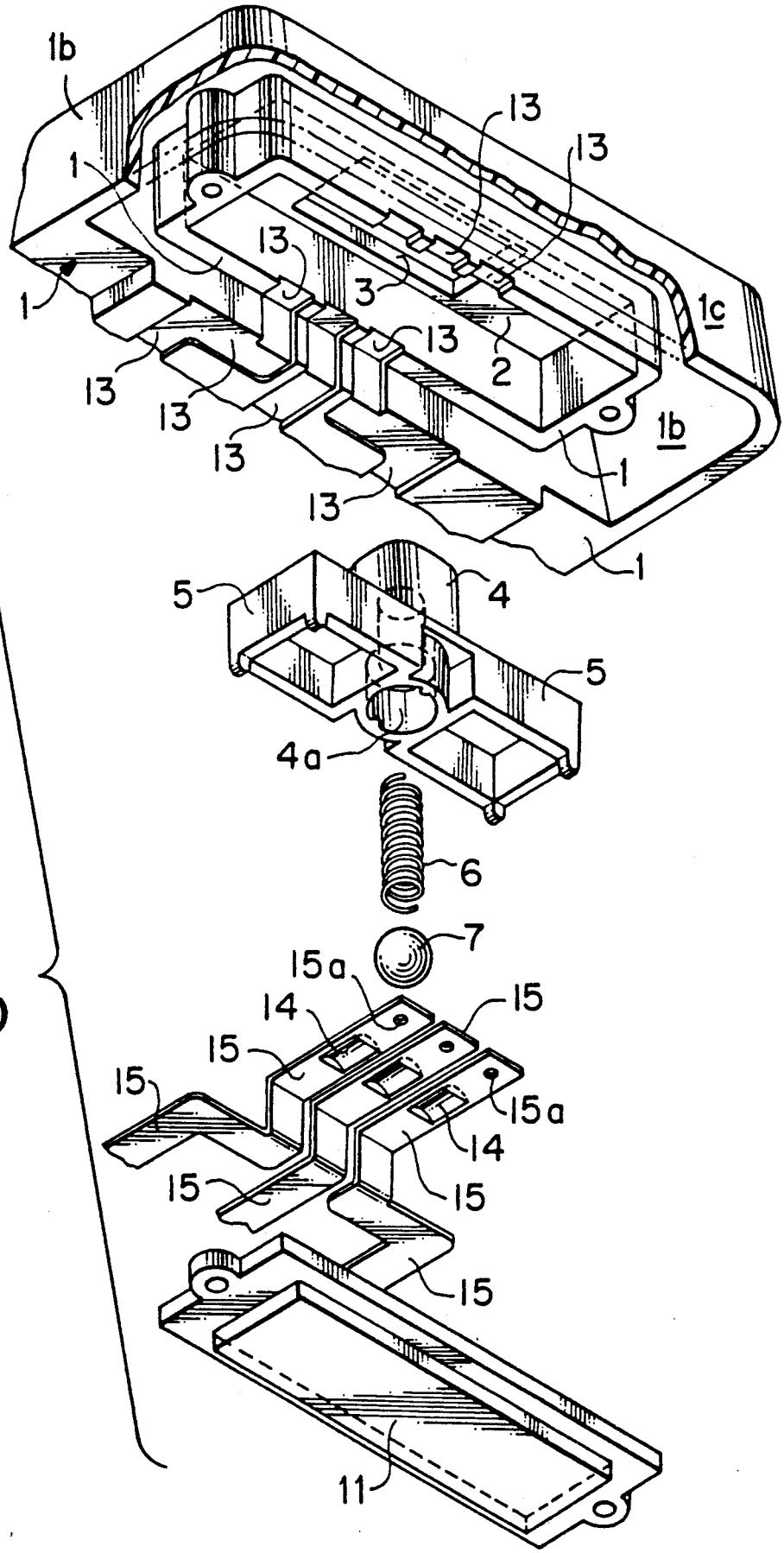
FIG. 10 is an exploded bottom perspective view of still another embodiment of the present invention.

The narrow conductive plates 15 are located by engaging small holes 15*a* thereof with respective projections on the insulated housing 1 as shown in FIG. 10 and are mounted on the bottom surface of the insulated housing 1 by inserting them into grooves 13 using anchoring pieces or locking screws (not shown) to complete the slide switch according to the present invention.

With the above arrangement, the present invention provides the following advantages. By providing plural round conductive pipes, conductive rods or conductive plates in longitudinal parallel arrangement as fixed conductors for the slide switch, a section of a knob-operated movable conductor will drop into the gaps between the fixed conductors in a snapping action due to the elasticity of a spring, thereby short-circuiting the fixed conductors on both sides of it to turn the switch on the elastic snapping action of the knob-operated movable conductor into the gaps between the fixed conductors provides a click action (i.e. snapping function). Thus, comfortable knob operation with a "clicking" action is achieved without specially designed structural members to provide snapping action as was previously used. At the same time this "clicking" action improves switch controllability.

Another advantage of this invention is that disengagement of the movable conductor from the gap by operating the knob will turn the switch off. As a result, the switch can serve as a single pole dual position switch or a double pole dual position switch if a part of the movable conductor is then engaged with another gap between a different set of fixed conductors.

Furthermore, since the conductive pipes, conductive rods or conductive plates used as fixed conductors may be integrally formed with the narrow conductive plates (i.e. the bus bars), the fixed conductors can be connected directly to other electronic components or circuit patterns via the bus bar. As a result, no clamping portion or lead wire is required. This leads to yet another advantage of this invention in terms of economy of resources, improving the efficiency during assembly and preventing unnecessary heat and consequent accidents (such as fire) by minimizing the electrical resistance or contact resistance in the circuit that is used.

In addition to the above, use of a conductive ball such as a steel ball as the movable conductor 7 will provide for smooth knob movement allowing smooth switch operation.

By reliably holding the fixed conductors in grooves 9 using the retaining plate 11, the switch contacts can be tightly enclosed for protection. This arrangement also reliably maintains the position of the plural fixed conductors ensuring stable operation for a long time.

While the invention has been particularly shown and described above with respect to preferred embodiments, it is apparent that the foregoing and other changes in form and detail may be made therein by one skilled in the art without departing from the spirit and scope of the invention.

I claim:

1. A slide switch comprising:

an electrically insulated support housing having opposing pairs of end and side walls which establish an interior cavity, an upper wall joined to an upper edge of said opposed pairs of said end and side walls to close an upper end of said interior cavity, said upper wall defining an opening in communication with said interior cavity;

an electrically insulated slide body which is slidably disposed within said interior cavity of said support housing so as to be movable reciprocally between first and second positions therewithin, said slide body having a knob which projects through said opening defined in said upper wall of said support housing to allow manual movement of said slide body between said first and second positions;

at least one pair of fixed elongate conductors each having opposing ends fixed to said opposed pair of side walls of said housing so that said pair of fixed conductors extend parallel to one another but are positioned in spaced relationship transversely relative to said reciprocal movement of said slide body; wherein said slide body also including a movable conductor sized and configured to be in contact with said pair elongate fixed conductors when said slide body is in said first position so as to make and electrical circuit therebetween, and to be disengaged from at least one of said fixed conductors when said slide body is in said second position so as to break electrical contact therebetween; and wherein said housing body further includes a retaining plate fixedly attached to a lower edge of said opposed pairs of end and side walls to close a lower end of said interior cavity such that said fixed conductors are in spaced relationship to said retaining plate.

2. A slide switch as in claim 1, wherein said movable conductor is an electrically conductive ball.

3. A slide switch as in claim 2, wherein said knob of said slide body includes a recess, and a spring received within said recess and acting upon said movable contact so as to urge the same in to contact with said fixed electrical conductors.

4. A slide switch as in claim 1, wherein said opposed pair of side walls include grooves adapted to receive a respective end portion of said fixed conductors.

5. A slide switch as in claim 1, wherein said fixed conductors are selected from elongate electrically conductive tubes, flat plates and rods.

* * * * *